US007422024B2

(12) United States Patent
Takahashi et al.

(10) Patent No.: US 7,422,024 B2
(45) Date of Patent: Sep. 9, 2008

(54) ULTRASONIC SHOWER CLEANING APPARATUS OF DOUBLE-SIDE CLEANING TYPE

(75) Inventors: Seigo Takahashi, Tokyo (JP); Junpei Ohkawara, Tokyo (JP); Kazunari Suzuki, Tokyo (JP)

(73) Assignee: Kaijo Corporation, Tokyo (JP)

( * ) Notice: Subject to any disclaimer, the term of this patent is extended or adjusted under 35 U.S.C. 154(b) by 600 days.

(21) Appl. No.: 10/909,187

(22) Filed: Jul. 30, 2004

(65) Prior Publication Data

US 2005/0087219 A1 Apr. 28, 2005

(30) Foreign Application Priority Data

Oct. 22, 2003 (JP) ..... 2003-361542

(51) Int. Cl.
*B08B 3/00* (2006.01)
*B08B 3/12* (2006.01)
*B08B 6/00* (2006.01)

(52) U.S. Cl. ..... 134/199; 134/99.1; 134/153; 134/157; 134/184; 134/186; 134/198; 134/902; 239/102.1

(58) Field of Classification Search ..... 134/153, 134/184, 198, 99.1, 157, 186, 199, 902; 239/102.1, 239/102.2

See application file for complete search history.

(56) References Cited

U.S. PATENT DOCUMENTS

| | | | |
|---|---|---|---|
| 4,064,884 | A | 12/1977 | Asp |
| 4,326,553 | A | 4/1982 | Hall |
| 4,834,124 | A | 5/1989 | Honda |
| 5,927,306 | A | 7/1999 | Izumi et al. |
| 6,241,162 | B1 | 6/2001 | Takahashi et al. |
| 6,543,080 | B1 | 4/2003 | Tomita et al. |
| 6,904,637 | B2 * | 6/2005 | Sugarman ..... 15/77 |

FOREIGN PATENT DOCUMENTS

| | | |
|---|---|---|
| EP | 0257397 | 3/1988 |
| EP | 0 688 607 | 12/1995 |
| JP | 5134398 | 5/1993 |
| JP | 2001-933 | 1/2001 |
| JP | 2001-53047 | 2/2001 |
| WO | WO95/17971 | 7/1995 |

OTHER PUBLICATIONS

Derwent Abstract Accession No. H0949C/33, SU 704682 A (Shaposhnikov) Dec. 28, 1979.
Derwent Abstract Accession No. 84-004392/01, SU 1000127 A (Agranat) Feb. 28, 1983.
Derwent Abstract Accession No. 96-475183/47, RU 2054978 C1 (Penza Tool Wks) Feb. 27, 1996.

* cited by examiner

*Primary Examiner*—Michael Barr
*Assistant Examiner*—Rita R Patel

(57) ABSTRACT

An ultrasonic shower cleaning apparatus is disclosed which is capable of efficiently cleaning both surfaces of an article and configured to have a reduced size enabling an installation space thereof to be decreased. A pair of ultrasonic shower cleaning mechanisms each include a nozzle, a disc-shaped ultrasonic transducer arranged so as to face a backward end of the nozzle and an inlet port for a cleaning liquid formed opposite to a side surface of the nozzle. The ultrasonic shower cleaning mechanisms are integrally incorporated in one casing in such a manner that axes of the nozzles cross each other at a predetermined angle. The casing is provided with one inlet branch port connected to the inlet ports of the ultrasonic shower cleaning mechanisms. The casing may have a groove formed therein in which an edge of the article arranged between the two nozzles can be inserted.

6 Claims, 4 Drawing Sheets

ULTRASONIC SHOWER CLEANING APPARATUS OF DOUBLE-SIDE CLEANING TYPE

BACKGROUND OF THE INVENTION

1. Field of the Invention

The present invention relates to an ultrasonic shower cleaning apparatus of a double-side cleaning type which is capable of simultaneously cleaning both sides or surfaces of an article to be cleaned such as a hard disc.

2. Description of the Related Art

The assignee of the present invention proposed an ultrasonic shower cleaning apparatus for cleaning a surface of an article to be cleaned, wherein a cleaning liquid is ejected, together with an ultrasonic wave, like shower as disclosed in U.S. Pat. No. 6,241,162, the disclosure of which is hereby incorporated by reference. Such an ultrasonic shower cleaning apparatus 40 has construction shown in FIG. 4. The ultrasonic shower cleaning apparatus 40 includes a nozzle 42 attached to a forward end of a casing 41, a disc-shaped ultrasonic transducer 43 arranged so as to be opposed to a backward end of the nozzle 42, and an inlet port 44 for a cleaning liquid formed on a side surface of the casing 41. The cleaning liquid supplied from the inlet port 44 and an ultrasonic wave emitted from the ultrasonic transducer 43 are ejected from the nozzle 42 so as to clean an article to be cleaned which is disposed in front of the nozzle 42. In such an ultrasonic shower cleaning apparatus, an outlet port 42*a* of the nozzle 42 is formed to have a linear circular hole, and a backward end surface of the nozzle 42 is formed to have a conical shape so as to be tapered towards the outlet port 42*a* from its outer edge at a predetermined angle. A guide mechanism 45 composed of annular flanges 45*a* and 45*a* is formed on a side surface of the nozzle 42.

In the ultrasonic shower cleaning apparatus 40, since the ultrasonic wave emitted from the nozzle 42 will not be focused on a fixed point, it is not necessary to precisely adjust a distance from an article to be cleaned to the forward end of the nozzle 42 at the time of cleaning, resulting in the working efficiency being improved. In addition, the cleaning liquid fed from the inlet port 44 is rectified by the guide mechanism 45 so as to be ejected as a uniform flow. At the same time, the emitted ultrasonic wave is repeatedly reflected between a bottom face 43*a* of the ultrasonic transducer 43 and the backward end surface of the nozzle 42 so as to be emitted with increased intensity. As a result, an extremely excellent cleaning effect can be achieved.

The ultrasonic shower cleaning apparatus proposed by the assignee of the present invention can achieve the high working efficiency and the excellent cleaning effect. The ultrasonic shower cleaning apparatus is, however, developed solely in order to clean one side or one surface of an article to be cleaned, and thus cannot simultaneously clean both sides or surfaces of the article to be cleaned. Accordingly, in the case of an article to be cleaned, such as a hard disc, of which both sides are required to be cleaned, when one side thereof has been cleaned, the article is necessitated to be inverted so as to clean the other side thereof. There, therefore, arises a problem that such cleaning takes a lot of effort and time.

As the most simple approach to solving such a problem, as shown in FIG. 5, two ultrasonic shower cleaning apparatuses 40 are provided and arranged in an opposed manner so as to interpose an article to be cleaned C between them, so that both sides of the article C may be simultaneously cleaned with a cleaning liquid W from the two ultrasonic shower cleaning apparatuses 40. In the case where the two ultrasonic shower cleaning apparatuses 40 are merely arranged in the opposed manner as shown in FIG. 5, however, an installation space for the entire cleaning apparatuses becomes large, and piping and pipe arrangement with respect to inlet ports of the cleaning apparatuses become complicated. As a result, the installation condition is greatly restricted.

As a double-side cleaning apparatus which uses only a normal cleaning liquid without using an ultrasonic wave, a high-pressure spray cleaning apparatus shown in FIG. 6 is known in the art. The high-pressure spray cleaning apparatus 60 is provided with hook-shaped cleaning liquid guide cylinders 61*a* and 61*b* which have ejecting nozzles 62*a* and 62*b* formed on inner sides of distal ends thereof, respectively, and which have inlet ports 63*a* and 63*b* for feeding a high-pressure cleaning liquid formed on proximal ends thereof, respectively. A high-pressure cleaning liquid W is ejected toward both sides or surfaces of an article to be cleaned C from the respective ejecting nozzles 62*a* and 62*b* while the article to be cleaned C is arranged between the ejecting nozzles 62*a* and 62*b* . In the case of the high-pressure spray cleaning apparatus 60 shown in FIG. 6, however, since only the cleaning liquid is used, the cleaning effect is not high, resulting in a problem that cleaning requires a lot of time and a large quantity of the cleaning liquid.

SUMMARY OF THE INVENTION

The present invention has been made in order to solve the above problems. Accordingly, it is an object of the present invention to provide an ultrasonic shower cleaning apparatus of a double-side cleaning type which is capable of efficiently cleaning both surfaces of an article to be cleaned, such as a hard disc, and which is capable of being configured to have a reduced size enabling an installation space thereof to be decreased.

In accordance with the present invention, an ultrasonic shower cleaning apparatus of a double-side cleaning type is provided. The ultrasonic shower cleaning apparatus comprises: a casing; and a pair of ultrasonic shower cleaning mechanisms, each including a nozzle having an outlet port formed at a center portion thereof, a disc-shaped ultrasonic transducer arranged so as to face a backward end of the nozzle and an inlet port for a cleaning liquid formed opposite to a side surface of the nozzle; the pair of ultrasonic shower cleaning mechanisms being integrally incorporated in the casing in such a manner that axes of the nozzles cross each other at a predetermined angle; the casing being provided with one inlet branch port connected to the inlet ports of the pair of ultrasonic shower cleaning mechanisms; wherein a cleaning liquid is fed to the pair of ultrasonic shower cleaning mechanisms via the inlet branch port while an article to be cleaned is arranged between the pair of nozzles, so that front and rear surfaces of the article can be cleaned simultaneously.

According to the ultrasonic shower cleaning apparatus of the present invention, a pair of ultrasonic shower cleaning mechanisms are integrally incorporated in one casing, so that both of the front and rear surfaces of the article to be cleaned such as a hard disc can be simultaneously cleaned. Further, such construction can achieve a size reduction of the entire apparatus. Moreover, since only one supply pipeline is used for feeding a cleaning liquid, pipe arrangement and a space necessary for piping have enhanced flexibility, so that an installation space of the apparatus can be utilized effectively.

In a preferred embodiment of the invention, the casing has a groove of a predetermined depth formed therein in which an edge of the article arranged between the pair of nozzles can be inserted. Such construction permits the article to be moved backwards and forwards to a deep depth into the groove and to a shallow depth in the groove at the time of cleaning, so that the front and rear surfaces of the article can be cleaned widely and effectively.

In a preferred embodiment of the invention, the groove is formed in such a manner that the depth of the groove is shallowest at the center thereof in a longitudinal direction thereof.

In a preferred embodiment of the invention, the predetermined angle at which the axes of the nozzles cross each other is set within a range of 30° to 180°.

DETAILED DESCRIPTION OF THE INVENTION

A preferred embodiment of the present invention will be described below with reference to the accompanying drawings.

Figure 1B:
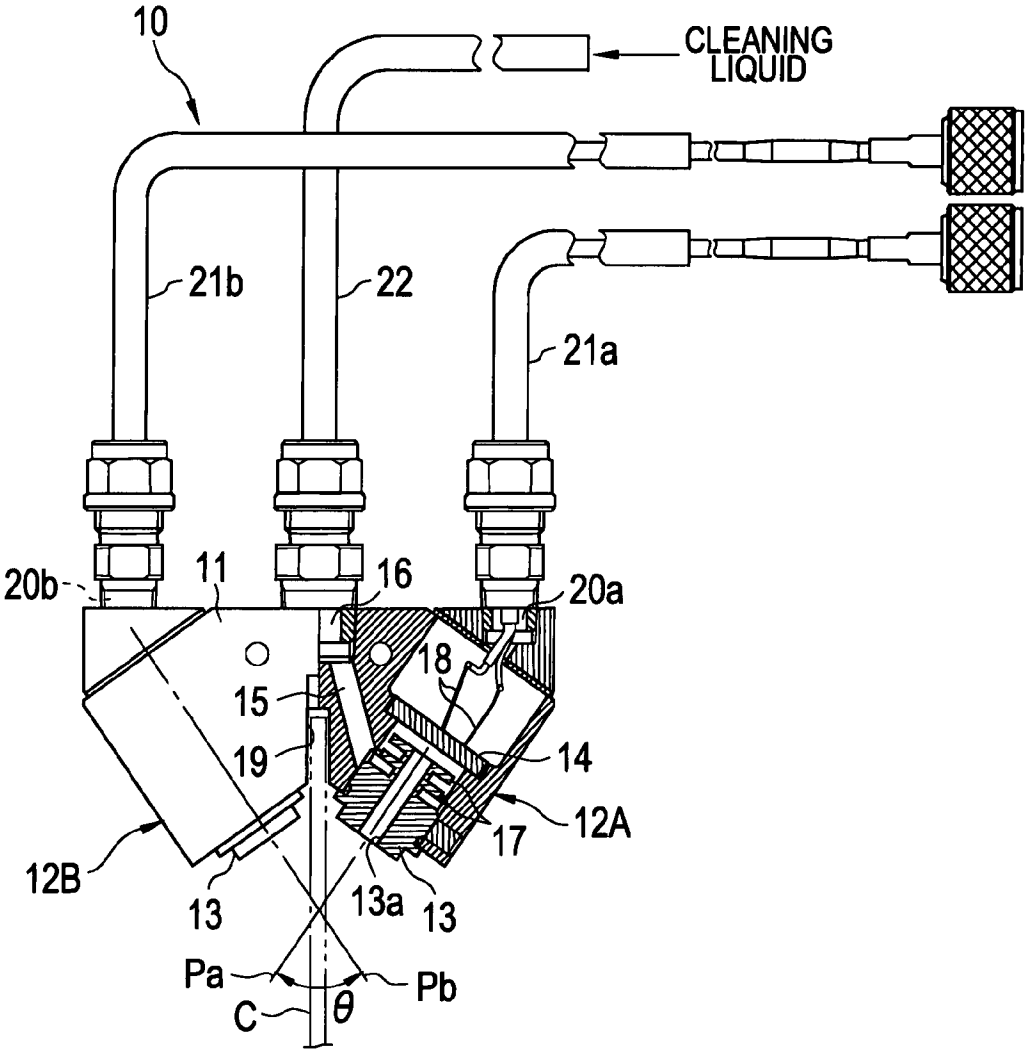
FIG. 1B is a front view illustrating partly in section the ultrasonic shower cleaning apparatus.
Figure 1A:
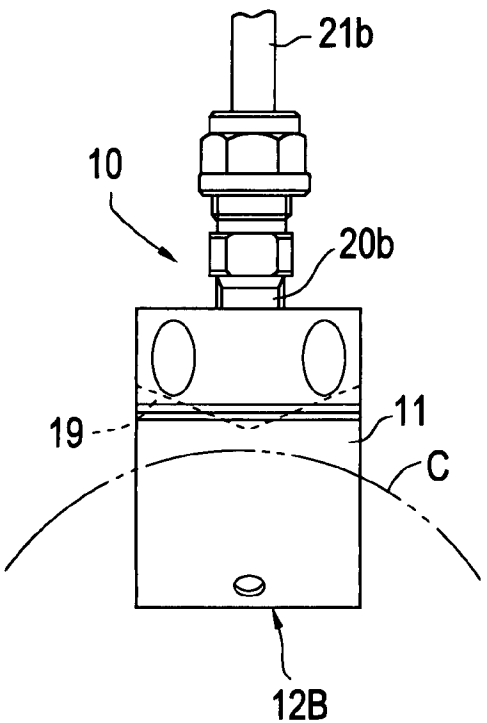
FIG. 1A is a left side view illustrating an ultrasonic shower cleaning apparatus of a double-side cleaning type according to one embodiment of the present invention.

Referring first to FIGS. 1A and 1B, FIGS. 1A and 1B illustrate an ultrasonic shower cleaning apparatus of a double-side cleaning type according to one embodiment of the present invention. The ultrasonic shower cleaning apparatus of a double-side cleaning type 10 according to the embodiment of the present invention is constructed so that a pair of ultrasonic shower cleaning mechanisms 12A and 12B having a structure similar to that of the ultrasonic shower cleaning apparatus 40 (see FIG. 1) of U.S. Pat. No. 6,241,162 are integrally incorporated in one casing 11. As a result, the ultrasonic shower cleaning apparatus 10 can clean both of front and rear surfaces of an article to be cleaned C simultaneously and can be reduced in size.

The casing 11 incorporating the pair of ultrasonic shower cleaning mechanisms 12A and 12B is formed to have such a symmetrical shape that both of the surfaces of the article C can be cleaned simultaneously. More specifically, as shown in FIG. 1B, one of the ultrasonic shower cleaning mechanisms 12A is disposed in a right half portion of the casing 11 and the other 12B is disposed in a left half portion of the casing 11 in such a manner that central axes Pa and Pb of nozzles 13 and 13 are tilted so as to cross each other at a predetermined angle θ, for example, of about 68° in the illustrated embodiment. The angle θ may be suitably determined or selected taking into consideration a size of the article to be cleaned C, cleaning performance of the apparatus, fabrication conditions and the like. Practically, the angle θ may be set within a range from about 30° to 180°.

The pair of ultrasonic shower cleaning mechanisms 12A and 12B have the same construction in which corresponding parts thereof are reversely arranged on the sides. The pair of ultrasonic shower cleaning mechanisms 12A and 12B each include a corresponding one of the nozzles 13 which has an outlet port 13*a* formed through a center portion thereof and which is disposed at a forward end of the mechanism. The nozzles 13 are mounted in respective bores formed in the casing 11. A pair of disc-shaped ultrasonic transducers 14 and 14 are each arranged in the casing 11 so as to face a backward end of a respective one of the nozzles 13 in the casing 11 at a predetermined distance apart from the backward end of the nozzle 13. A pair of inlet ports 15 for feeding a cleaning liquid are each formed in the casing 11 opposite to a side surface of a respective one of the nozzles 13. The pair of inlet ports 15 are connected with a single inlet branch port 16 formed in an upper portion of the casing 11.

Each of the nozzles 13 has two disc-shaped flanges 17 formed on the backward end thereof at a position where the inlet port 15 is opened, so that the two flanges 17 constitute a guide mechanism for feeding the cleaning liquid supplied via the inlet port 15 as a uniform flow into the outlet port 13*a*.

The upper surface of an upper one of the two flanges 17 constituting the guide mechanism is formed to be such a conical surface which slopes down towards the outlet port 13*a* at a predetermined angle (for example, of 0.5° to 15°) that an ultrasonic wave emitted from the ultrasonic transducer 14 is repeatedly reflected between a bottom face of the ultrasonic transducer 14 and the upper surface of the upper flange 17 so as to be converged on a position of the outlet port 13*a* and ejected, together with the cleaning liquid, from the outlet port 13*a* to the outside. Further, the upper flange 17 desirably has a thickness of ¼ of an ultrasonic wavelength λ in order to allow the ultrasonic wave emitted from the ultrasonic transducer 14 to be reflected efficiently.

The casing 11 has an article insertion groove 19 of a predetermined depth, into which an edge of the article to be cleaned C can be inserted, formed in a center portion of the lower surface thereof so as to be positioned in a borderline between the ultrasonic shower cleaning mechanisms 12A and 12B arranged symmetrically. As will be described in detail later, the article insertion groove 19 allows the edge of the article to be cleaned C such as a hard disc to be inserted therethrough at the time of cleaning, whereby cleaning is executed so that the front and rear surfaces of the article C can be cleaned widely and effectively. The article insertion groove 19, as shown in FIG. 1A, has a bottom which has a substantial V-shape as viewed from the side or as viewed in a direction perpendicular to a longitudinal direction of the groove 19 so that the cleaning apparatus 10 can execute cleaning while being oscillated. That is, the article insertion groove 11 is formed in such a manner that the depth of the groove 11 is shallowest at the center thereof in a longitudinal direction thereof. In addition, such a configuration of the article insertion groove 19 can effectively drain the used cleaning liquid containing particles or the like from the groove 19 due to an inclination of the bottom of the groove 19, to thereby prevent the used cleaning liquid from remaining in the groove 19. Especially, when the cleaning apparatus 10 is disposed below an article to be cleaned C so as to eject a cleaning liquid along with an ultrasonic wave upwards, the inclined bottom of the article insertion groove 19 positively drains the used cleaning liquid from the groove 19, to thereby prevent particles or the like from redepositing on the surfaces of the article C.

A set of leads or wires 18 for supplying a high-frequency electric current for generating an ultrasonic wave to the ultrasonic transducer 14 is drawn out from a corresponding one of power distribution ports 20*a* and 20*b* formed on the opposite sides of the upper surface of the casing 11. The set of wires 18 is connected to an ultrasonic high-frequency generating apparatus (not shown) through a connecting cable 21*a* or 21*b*. The inlet branch port 16 for feeding a cleaning liquid in a branched manner is connected to a cleaning liquid source or a cleaning liquid supplying apparatus (not shown) through one supply pipeline 22.

A manner of cleaning using the ultrasonic shower cleaning apparatus of a double-side cleaning type 10 thus constructed will be explained below.

At the time of cleaning, as shown by phantom line in FIGS. 1A and 1B, the article to be cleaned C such as a hard disc is inserted into the article insertion groove 19, and the article to be cleaned C is rotated by a rotary mechanism (not shown) at a predetermined speed. Then, a cleaning liquid W is fed through the supply pipeline 22 at a predetermined pressure to the pair of nozzles 13 via the inlet branch port 16 and the inlet ports 15, so that the cleaning liquid W is ejected to the front and rear surfaces of the rotating article to be cleaned C from both of the outlet ports 13*a* formed on the center portions of the respective nozzles 13. Further, a high-frequency electric current is supplied to the ultrasonic transducers 14 on both sides via the connecting cables 21*a* and 21*b*, so that an ultrasonic wave is emitted from each of the ultrasonic transducers 14.

The ultrasonic wave emitted from the ultrasonic transducer 14 is repeatedly reflected between the upper surface of the upper one of the two flanges 17 constituting the guide mechanism and the bottom face of the ultrasonic transducer 14, to thereby converge on the outlet port 13*a*. The ultrasonic wave, together with the cleaning liquid, is emitted from the forward end of the outlet port 13*a* of each nozzle 13 to the article to be cleaned C. Thereby, particles and foreign matter which adhere to the front and rear surfaces of the article to be cleaned C can be peeled off by ultrasonic vibration and can be simultaneously rinsed off by the cleaning liquid. As a result, an extremely high cleaning effect can be achieved.

Figure 2:
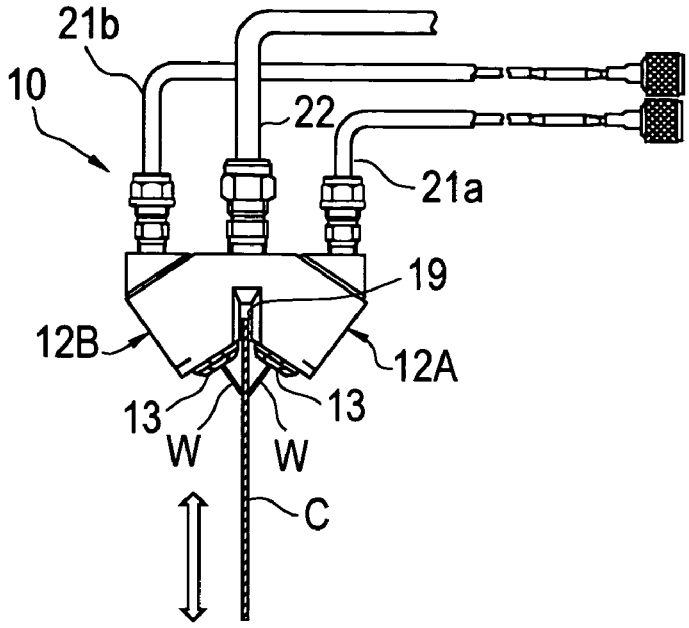
FIG. 2 is a schematic illustration showing a manner of use of the apparatus.
Figure 3:
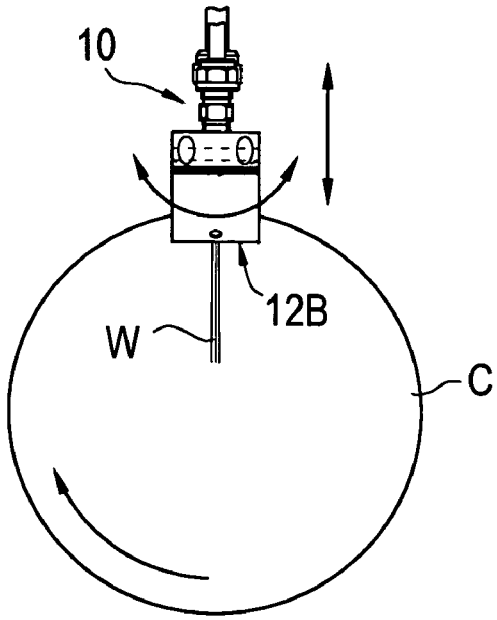
FIG. 3 is a schematic illustration showing another manner of use of the apparatus.
Figure 4:
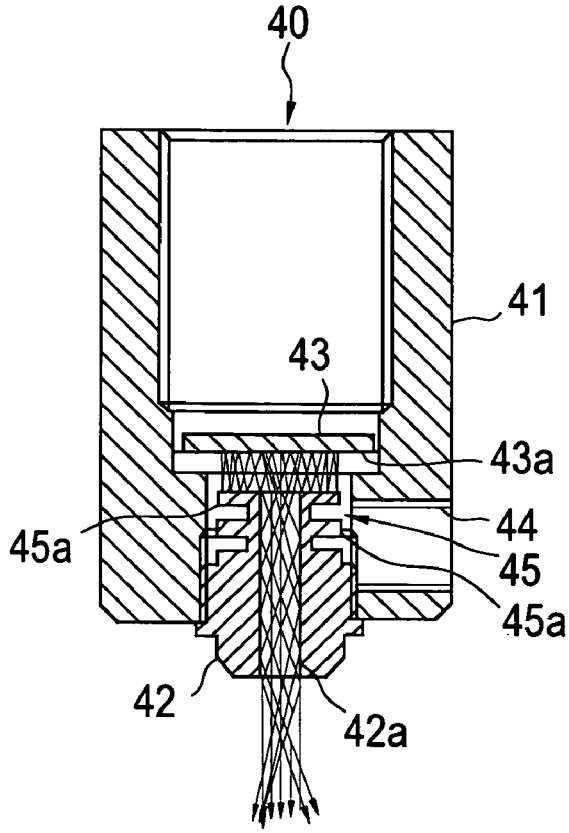
FIG. 4 PRIOR ART
FIG. 4 is a sectional view illustrating construction of an ultrasonic shower cleaning apparatus previously proposed by the assignee.
Figure 5:
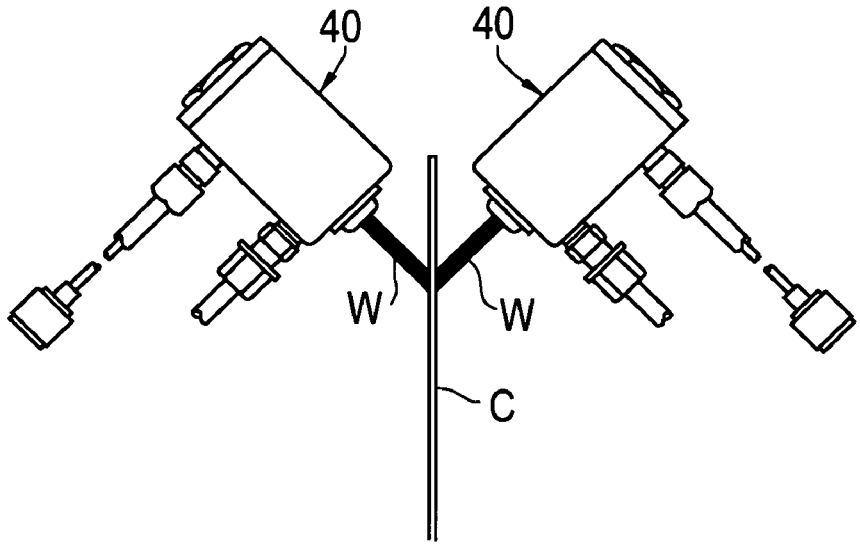
FIG. 5 PRIOR ART
FIG. 5 is a diagram showing the arrangement of the ultrasonic shower cleaning apparatuses in the case where a pair of the ultrasonic shower cleaning apparatuses of FIG. 4 are applied to double-side cleaning.
Figure 6:
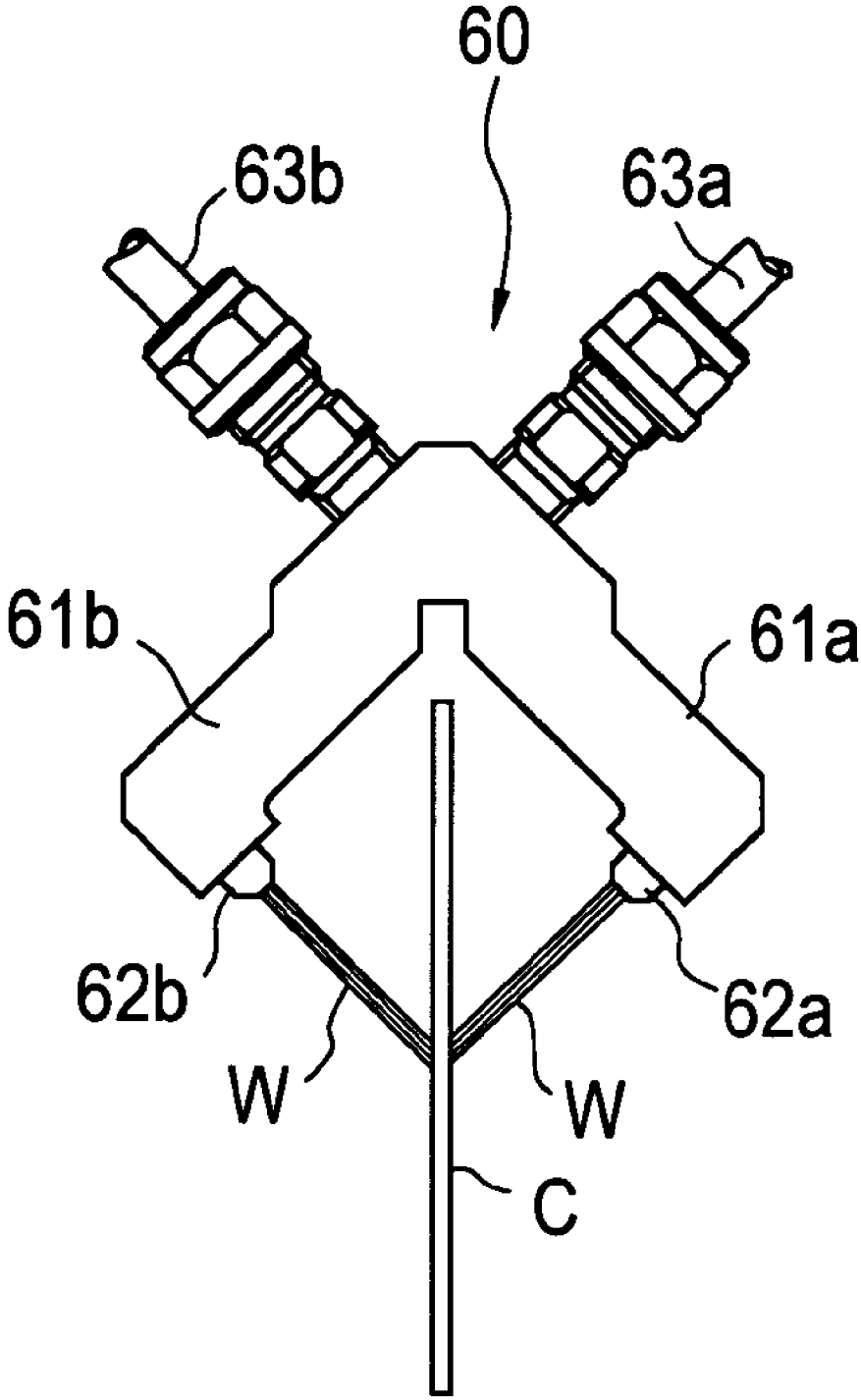
FIG. 6 PRIOR ART
FIG. 6 is a schematic view of a high-pressure spray cleaning apparatus of a conventional double-side cleaning type using only a cleaning liquid.

In the cleaning described above, only the article to be cleaned C is rotated. However, the article to be cleaned C may be cleaned while the article C is not only rotated but also vertically moved simultaneously as shown in FIG. 2. Alternatively, as shown in FIG. 3, the article to be cleaned C may be cleaned while only the article C is rotated, whereas the cleaning apparatus 10 is simultaneously oscillated laterally or moved vertically. As a result, the front and rear surfaces of the article to be cleaned C can be cleaned more effectively.

While the illustrative and presently preferred embodiment of the present invention has been described in detail herein, it is to be understood that the inventive concepts may be otherwise variously embodied and employed and that the appended claims are intended to be construed to include such variations except insofar as limited by the prior art.

What is claimed is:

1. An ultrasonic shower cleaning apparatus of a double-side cleaning type, comprising:

a casing; and a pair of ultrasonic shower cleaning mechanisms, each including a nozzle having an outlet port formed at a center portion thereof, a disc-shaped ultrasonic transducer arranged so as to face a backward end of the nozzle and an inlet port for a cleaning liquid formed opposite to a side surface of the nozzle;

the pair of ultrasonic shower cleaning mechanisms being integrally incorporated in the casing in such a manner that axes of the nozzles cross each other at a predetermined angle;

the casing being provided with one inlet branch port connected to the inlet ports of the pair of ultrasonic shower cleaning mechanisms and having a groove of a predetermined depth formed therein positioned in the casing and aligned above the crossing of the axes of the nozzles and configured so that an edge of the article arranged between the pair of nozzles can be inserted, wherein the groove is formed in such a manner that the depth of the groove is shallowest at a center in the length of the groove in a longitudinal direction thereof above the crossing of the axes of the nozzles, wherein a cleaning liquid is fed to the pair of ultrasonic shower cleaning mechanisms via the inlet branch port while an article to be cleaned is arranged between the pair of nozzles, so that front and rear surfaces of the article can be cleaned simultaneously.

2. The ultrasonic shower cleaning apparatus according to claim 1, wherein the predetermined angle at which the axes of the nozzles cross each other is set within a range of 30° to 180°.

3. In an ultrasonic projecting cleaning fluid assembly for cleaning both sides of a relatively flat article, the improvement comprising:

a housing having a first opening for receiving a first ultrasonic transducer unit, a second opening for receiving a second ultrasonic transducer unit and an indented groove centrally located in the housing and positioned between the first opening and the second opening in the housing, the indented groove is of a size to accommodate relative movement of the article to be cleaned, a longitudinal axis of the first opening and a longitudinal axis of the second opening cross each other below the indented grove whereby projected fluid along the respective axes can apply cleaning fluid to the article partially contained within the groove wherein a bottom surface of the groove has a cross-sectional V-shape with its apex located above a crossing of the longitudinal axes of the first and second openings.

4. An ultrasonic projecting cleaning fluid assembly for cleaning both sides of a relatively flat article comprising;

a first ultrasonic transducer unit with a nozzle;

a second ultrasonic transducer unit with a nozzle;

a unitary housing having a first opening for receiving the first ultrasonic transducer unit, a second opening for receiving the second ultrasonic transducer unit and an indented groove centrally located in the housing and positioned between the first opening and the second opening, the indented groove is of a size to accommodate relative movement of the article to be cleaned, an axis of the first opening and an axis of the second opening cross each other below the indented grove whereby projected fluid from the respective nozzles extending along the respective axes enable an application of cleaning fluid to the article when partially contained within the groove; and means for draining used cleaning fluid from the groove including a surface of the groove having a cross-sectional V-shape.

5. The ultrasonic assembly of claim 4 wherein the unitary housing has an input port for receiving a supply of cleaning fluid and a first passageway in the housing for connecting the input port with the first ultrasonic transducer unit and a second passageway in the housing for connecting the input port with the second ultrasonic transducer unit.

6. The ultrasonic assembly of claim 5 wherein a bottom surface of the groove has the cross-sectional V-shape and the apex of the V-shape is closest to the position of an article during a cleaning mode of operation.

* * * * *